US009803394B2

(12) United States Patent
Frolov et al.

(10) Patent No.: US 9,803,394 B2
(45) Date of Patent: Oct. 31, 2017

(54) ELECTRONIC DEADBOLT LOCK

(71) Applicant: Schlage Lock Company LLC, Indianapolis, IN (US)

(72) Inventors: George Frolov, Farmington, CT (US); John E. Walsh, Wallingford, CT (US); Victor Bogdanov, Manchester, CT (US); Alfred S. Levesque, Newington, CT (US); Kevin D. Miller, Unionville, CT (US); Don Shilonie, Shelton, CT (US); Adam O'Day, Bristol, CT (US)

(73) Assignee: Schlage Lock Company LLC, Carmel, IN (US)

( * ) Notice: Subject to any disclaimer, the term of this patent is extended or adjusted under 35 U.S.C. 154(b) by 86 days.

(21) Appl. No.: 14/590,822

(22) Filed: Jan. 6, 2015

(65) Prior Publication Data

US 2015/0114055 A1 Apr. 30, 2015

Related U.S. Application Data

(63) Continuation of application No. 12/295,641, filed as application No. PCT/US2007/009075 on Apr. 12, 2007, now Pat. No. 8,931,315.
(Continued)

(51) Int. Cl.
*E05B 47/00* (2006.01)
*E05B 47/06* (2006.01)
(Continued)

(52) U.S. Cl.
CPC ..... *E05B 47/0692* (2013.01); *E05B 47/0001* (2013.01); *E05C 1/02* (2013.01); *G07C 9/00174* (2013.01); *E05B 47/00* (2013.01); *E05B 47/0012* (2013.01); *E05B 2047/0016* (2013.01); *E05B 2047/0026* (2013.01); *Y10T 70/5823* (2015.04); *Y10T 70/70* (2015.04); *Y10T 70/7102* (2015.04); *Y10T 70/7107* (2015.04)

(58) Field of Classification Search
CPC ..... E05B 13/00; E05B 13/005; E05B 13/101; E05B 17/044; E05B 17/045; E05B 47/00; E05B 47/0001; E05B 47/0012; E05B 47/0676; E05B 47/0692; E05B 2047/0026; E05B 2047/0027; E05B 2047/0031
See application file for complete search history.

(56) References Cited

U.S. PATENT DOCUMENTS 4,676,083 A 6/1987 Sedley et al.
5,136,870 A 8/1992 Gartner
(Continued)

OTHER PUBLICATIONS

International Search Report, International Application No. PCT/US07/09075, Dec. 20, 2007, 3 pages.

*Primary Examiner* — Christopher Boswell
(74) *Attorney, Agent, or Firm* — Taft Stettinius & Hollister LLP

(57) ABSTRACT

A deadbolt lock assembly comprising a retractable and extendable deadbolt, a housing, an outside member movably mounted on the housing, the member being normally disconnected from the deadbolt, and an operator input device on the housing, the device connecting the member to the deadbolt in response to presentation of an appropriate credential, such that a force applied to the member by the operator is mechanically transmitted to the deadbolt to move the deadbolt.

16 Claims, 14 Drawing Sheets

Related U.S. Application Data

(60) Provisional application No. 60/744,782, filed on Apr. 13, 2006.

(51) Int. Cl.

| | |
|---|---|
| ***E05B 13/10*** | (2006.01) |
| ***E05C 1/02*** | (2006.01) |
| ***G07C 9/00*** | (2006.01) |

(56) References Cited

U.S. PATENT DOCUMENTS

| | | | | |
|---|---|---|---|---|
| 5,475,996 | A | 12/1995 | Chen et al. | |
| 5,640,863 | A | 6/1997 | Frolov et al. | |
| 5,987,945 | A * | 11/1999 | Ruano Aramburu | E05B 47/0692 70/107 |
| 6,286,347 | B1 | 9/2001 | Frolov | |
| 6,363,762 | B1 * | 4/2002 | Kueng | E05B 47/063 70/278.3 |
| 6,876,293 | B2 | 4/2005 | Frolov et al. | |
| 6,895,791 | B2 | 5/2005 | Alexander et al. | |
| 6,935,149 | B1 | 8/2005 | Peng et al. | |
| 7,007,526 | B2 * | 3/2006 | Frolov | E05B 47/068 70/107 |
| 7,091,429 | B2 | 8/2006 | Case et al. | |
| 7,096,697 | B2 | 8/2006 | Keightly | |
| 7,096,698 | B2 | 8/2006 | Walsh, III et al. | |
| 7,168,276 | B2 | 1/2007 | Errani et al. | |
| 7,543,469 | B1 | 6/2009 | Tseng et al. | |
| 7,872,577 | B2 * | 1/2011 | Frolov | E05B 45/06 340/5.32 |
| 8,302,438 | B2 * | 11/2012 | Lui | E05B 47/0012 70/277 |
| 8,353,189 | B2 * | 1/2013 | Bogdanov | E05B 47/0692 70/278.3 |
| 8,555,685 | B2 * | 10/2013 | Frolov | E05B 47/0673 292/137 |
| 8,931,315 | B2 * | 1/2015 | Frolov | E05B 47/0692 70/222 |
| 2005/0172685 | A1 | 8/2005 | Keightly | |

* cited by examiner

ELECTRONIC DEADBOLT LOCK

CROSS-REFERENCE TO RELATED APPLICATIONS

This application is a continuation of U.S. patent application Ser. No. 12/295,641 filed on Oct. 1, 2008, which is a national stage entry of PCT/US2007/009075 filed on Apr. 12, 2007, which claims the benefit of U.S. Provisional Patent Application Ser. No. 60/744,782 filed on Apr. 13, 2006, the contents of each of which are hereby incorporated by reference in their entirety.

BACKGROUND

The invention relates to deadbolt locks for doors.

SUMMARY OF THE INVENTION

The invention provides a deadbolt lock assembly comprising a retractable and extendable deadbolt, a housing, an outside member movably mounted on the housing, the member being normally disconnected from the deadbolt, and an operator input device on the housing, the device connecting the member to the deadbolt in response to presentation of an appropriate credential, such that a force applied to the member by the operator is mechanically transmitted to the deadbolt to move the deadbolt.

The invention also provides a deadbolt lock assembly comprising a retractable and extendable deadbolt, a housing, a credential reading device on the housing, an outside turnpiece pivotally mounted on the housing, the turnpiece being normally disconnected from the deadbolt, and a mechanism operable to connect the turnpiece to the deadbolt so that an operator can turn the turnpiece to move the deadbolt, the mechanism connecting the turnpiece to the deadbolt when an operator presents an appropriate credential to the credential reading device.

The invention also provides a deadbolt lock assembly comprising a retractable and extendable deadbolt, a housing, a credential reading device on the housing, an outside turnpiece pivotally mounted on the housing, the turnpiece being normally disconnected from the deadbolt, a key operated lock mechanism on the housing, and a mechanism operable to connect the turnpiece to the deadbolt so that an operator can turn the turnpiece to move the deadbolt, the mechanism connecting the turnpiece to the deadbolt either when an operator uses a key in the key operated lock mechanism or when an operator presents an appropriate credential to the credential reading device.

The invention also provides a deadbolt lock assembly comprising a retractable and extendable deadbolt, a housing, an outside turnpiece pivotally mounted on the housing, the turnpiece being normally disconnected from the deadbolt, a key operated lock mechanism on the turnpiece, and a mechanism operable to connect the turnpiece to the deadbolt so that an operator can turn the turnpiece to move the deadbolt, the mechanism connecting the turnpiece to the deadbolt when an operator uses a key in the key operated lock mechanism.

The invention also provides a method of operating a deadbolt lock assembly, the assembly including a retractable and extendable deadbolt, a housing, a credential reading device on the housing, a key operated lock mechanism on the housing, and an outside turnpiece pivotally mounted on the housing, the turnpiece normally disconnected from the deadbolt, the method comprising alternatively performing one of the following acts to cause engagement between the turnpiece and the deadbolt: inserting a key in the key operated lock mechanism, and thereafter turning the key, or presenting an appropriate credential to the credential reading device; and thereafter turning the turnpiece to thereby move the deadbolt.

The invention also provides a method of operating a deadbolt lock assembly, the assembly including a retractable and extendable deadbolt, a housing, a credential reading device on the housing, a key operated lock mechanism on the housing, and an outside turnpiece pivotally mounted on the housing, the turnpiece being normally disconnected from the deadbolt, the method comprising presenting an appropriate credential to the credential reading device, thereby connecting the turnpiece to the deadbolt, and thereafter turning the turnpiece to move the deadbolt.

The invention also provides a method of operating a deadbolt lock assembly, the assembly including a retractable and extendable deadbolt, a housing, a credential reading device on the housing, a key operated lock mechanism on the housing, and an outside turnpiece pivotally mounted on the housing, the turnpiece being normally disconnected from the deadbolt, the method comprising presenting an appropriate credential to the credential reading device, thereby connecting the turnpiece to the deadbolt, and thereafter turning the turnpiece to move the deadbolt.

Other features and advantages of the invention will become apparent to those skilled in the art upon review of the following description, claims and drawings.

BRIEF DESCRIPTION OF THE DRAWINGS

FIG. 9 is a view similar to FIG. 7 but with the key pushed in.

FIG. 14 is a view similar to FIG. 13 but with the key pushed in.

DETAILED DESCRIPTION

Figures 1A, 1B, 1C:
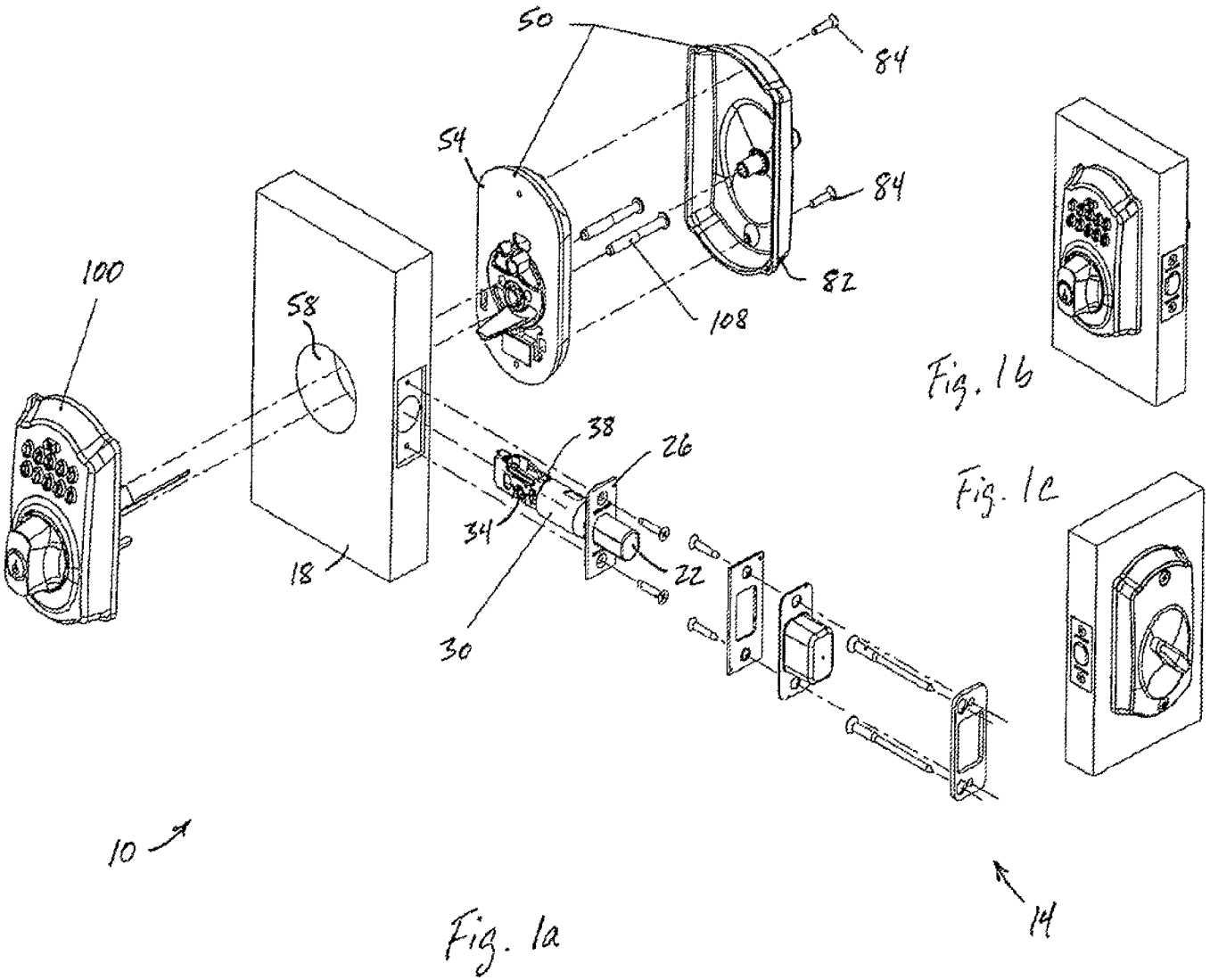
FIG. 1*a* is an exploded perspective view of a deadbolt lock assembly embodying the invention.
FIG. 1*b* is a perspective view of the outside of the assembly mounted on a door.
FIG. 1*c* is a perspective view of the inside of the assembly mounted on a door.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items, Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The deadbolt lock assembly 10 comprises (see FIG. 1) a conventional deadbolt assembly 14 mounted in a door 18 in the usual manner. The deadbolt assembly 14 includes a deadbolt 22 extendable and retractable through an opening in a face plate 26. The assembly also includes a frame 30 having therein an opening 34. A linkage 38 inside the frame is operably connected to the deadbolt 22. Movement of the linkage 38 is controlled by a driver bar 42 (described below) that extends through the opening 34 such that pivotal movement or rotation of the driver bar 42 about its longitudinal axis 46 in one direction extends the deadbolt 22 and movement of the driver bar 42 in the other direction retracts the deadbolt 22. The foregoing arrangement is well known in the art. Any other type of deadbolt assembly operable by a driver bar as described above can be used.

Figure 2:
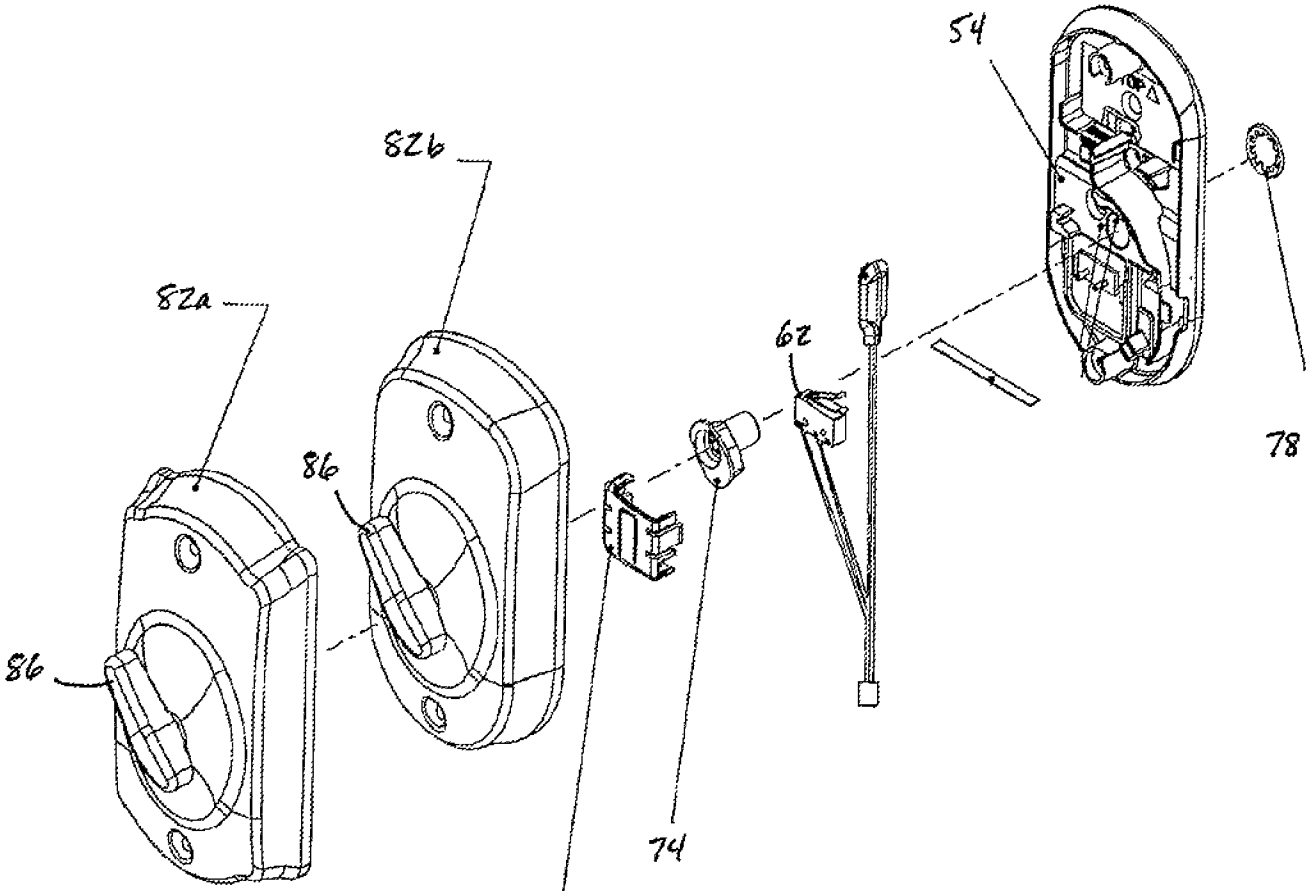
FIG. 2 is an exploded perspective view of the inside escutcheon assembly of the deadbolt lock assembly.

The dead bolt lock assembly 10 also comprises (see FIGS. 1 and 2) an inside escutcheon assembly 50. The inside escutcheon assembly 50 includes a base plate 54 mounted on the inside of the door over a hole 58 through the door. A switch 62 is mounted on the base plate 54, and a cover 66 is secured to the base plate over the switch 62. The switch 62 is connected to a printed circuit board or controller 70 that is described below. A battery (not shown) mounted on the base plate 54 is also connected to the circuit board. A cam 74 extends through an opening in the base plate and is retained by a retaining ring 78. The cam 74 is pivotally movable between a lock-open position in which the cam 74 closes the switch 62 and a lock-closed position in which the cam 74 allows the switch to be open. The cam 74 is mounted on the driver bar 42 such that the cam 74 is in the lock-open position when the deadbolt is retracted and is in the lock-closed position when the deadbolt is extended. The inside escutcheon assembly 50 also includes an inside escutcheon 82 mounted on the base plate 54. Alternative escutcheons 82*a* and 82*b* are shown in FIG. 2. The escutcheon 82 is secured to the base plate 54 by screws 84 in the usual manner. The escutcheon 82 has pivotally mounted thereon a conventional thumbturn or turnpiece 86 that is operably connected to the driver bar as is known.

The deadbolt lock assembly 10 also comprises (see FIGS. 1 and 3) an outside escutcheon assembly 100. The outside escutcheon assembly includes a base plate 104 mounted on the outside of the door over the hole 58. The outside base plate 104 is secured to the inside base plate 54 by screws 108 as is known in the art. This secures both base plates to the door. A motor assembly 112 is mounted on the base plate 104. The motor assembly 112 includes an electric motor 116 connected to the circuit board 70 such that the circuit board controls operation of the motor as described below. An output shaft extends downward from the motor and is drivingly connected to a coil spring 120 such that the spring rotates with the shaft. A holder 124 is fixed to the base plate 104 and retains the motor 116 in position. The printed circuit board 70 is mounted on the holder 124, and a keypad 128 is mounted on the holder 124 over the circuit board 70 such that the circuit board receives input from the keypad. The keypad 128 and the circuit board 70 are parts of a credential reading device. In this case the credential is a code that is entered on the keypad. In other embodiments of the invention, a credential can be any valid "code" or valid data, which could include one or more data elements. The data can be any suitable type of information, including biometric information, or digital information on swipe cards, ibuttons, etc.

A clutching cam 132 is mounted on the base plate 104 for pivotal movement about the longitudinal axis 46 of the driver bar 42. The outer end of the cam 132 (the left end in FIG. 3) has therein perpendicular slots 134 forming a cross shape. The inner end of the cam 132 is drivingly connected to the driver bar 42, such that the driver bar 42 and the cam 132 pivot together about the axis 46 with the inside earn 74 and with the inside turnpiece 86. A pin 136 is movably supported by the cam 132 for movement along a line generally perpendicular to the axis 46 and between inner and outer or engaged and disengaged positions. The pin 136 is biased toward its disengaged position by a spring 140. The outer end of the pin 136 is rounded to form a camming surface.

A retaining wall 144 is movably mounted on the base plate 104 below the holder 124. The wall 144 is operably connected to the coil spring 120 such that the wall is movable by the motor 116 between upper and lower or engaged and disengaged positions. Specifically, the wall 144 and the spring 120 are interconnected, as is known in the art, such that rotation of the spring 120 causes vertical movement of the wall in either direction depending on the direction of rotation of the spring. More particularly, the wall 144 has extending therefrom a pin (not shown) that extends into the coil of the spring 120 such that rotation of the spring 120 acts on the pin in a screw-like manner to move the pin and thereby the wall 144 up or down depending on the direction of rotation of the spring. Such an arrangement is disclosed in U.S. Pat. Nos. 5,640,863 and 6,286,347, both of which are incorporated herein by reference. The wall 144 has an upper extension that extends above the can 132 and that has a generally horizontal upper surface 148. The wall 144 also has a lower extension below the cam 132. The lower extension has an upwardly facing, arcuate camming surface 152 defining a portion of a circle. The camming surface 152 engages the outer end of the pin 136. When the wall 144 is in its upper position, the camming surface 152 is centered on the axis 46. As the wall 144 moves to its upper position, the camming surface 152 moves the pin 136 to its engaged position. The circular configuration of the surface 152 allows the cam 132 and the pin 136 to pivot about the axis while the pin 136 is engaging the surface 152. This also allows the surface 352 to engage the pin 136 regardless of the location of the pin, which location varies with the pivotal or rotational orientation of the cam 132, which depends on whether the deadbolt is locked or unlocked.

A manual release cam 156 is pivotally mounted on the base plate 104 above the wall 144. The cam 156 extends through an opening in the base plate 104 and through an opening in the inside base plate 54. The inner end of the cam 156 (the right end in FIG. 3) is accessible by removing the inside escutcheon 82, and the inner end of the cam 156 has therein a slot engageable by a screwdriver. The cam 156 includes a camming surface 160 engageable with the upper surface 148 of the wall. The cam 156 is pivotal between an engaged position and a disengaged position. The cam 156 is normally held in its engaged position by a spring plate 164 that is mounted on the base plate 104 and that engages a generally D-shaped upper surface 168 of the cam. The D-shaped surface 168 of the cam and the spring plate 164 create an over-center mechanism that holds the cam 156 in the position it is in, normally the engaged position. The force of the spring plate 164 must be overcome to pivot the cam 156 to a different position.

When the wall 144 is in its upper position, the upper surface 148 of the wall abuts or is closely spaced from the camming surface 160 of the cam when the cam 156 is in its engaged position. From this state, pivotal movement of the cam 156 to its disengaged position (this is done manually with a screwdriver, as further described below) causes the camming surface 160 of the cam to push downward on the upper surface 148 of the wall and move the wall 144 to its lower position. Such movement of the wall 144 and the camming surface 152 allows the pin 136 to return to its disengaged position under the force of the spring 140. The reason for this is described below.

A retaining plate 172 is mounted to the base plate 104 over the wall 144. The retaining plate 172 has therein a circular opening 176 centered on the axis, and an adapter 180 is mounted in the opening 176 for pivotal movement about the axis and relative to the base plate 104. A retaining ring 184 holds the adapter 180 in the opening. The inner end (the right end in FIG. 3) of the adapter is generally cylindrical and has therein a plurality of, and preferably six, axially extending notches 188 spaced around the inner end. When the pin 136 on the clutching cam 132 is in its inner or engaged position, the pin 136 extends into one of the notches 188 such the clutching cam 132 and the adapter 180 pivot together. Consequently, when the pin 136 is in its engaged position, pivotal movement of the adapter 180 causes like pivotal movement of the clutching cam 132, the driver bar 142 and the inside turnpiece 86. The outer end of the adapter 180 is generally cylindrical with a greater radius than the inner end. The outer end has thereon two diametrically opposed flats 192, and the outer end has therein a rectangular slot 196 centered on the axis.

An outer thumbturn or turnpiece 200 is mounted on the adapter 180 (and on an outer escutcheon 204 described below) for pivotal movement therewith. The outer end of the adapter 180 extends into the inner end of the turnpiece 200, and the turnpiece has flats engaging the flats 192 on the adapter such that the turnpiece and the adapter pivot together. When the turnpiece 200 is in a vertical position, as shown in FIG. 1, the slot 196 in the adapter extends vertically. Housed within the turnpiece 200 is a key operated lock mechanism or cylinder lock 208. The lock includes an outer housing 212 supported within the turnpiece such that the housing 212 is permitted limited axial movement relative to the turnpiece and is substantially prevented from pivoting or rotating relative to the turnpiece. Thus, the lock 208, the turnpiece 200 and the adapter 180 pivot together. The lock housing 212 has an extension or fin 216 that extends into a complementary recess in the turnpiece to facilitate such relative movement of the housing 212 and the turnpiece 200.

Figure 7:
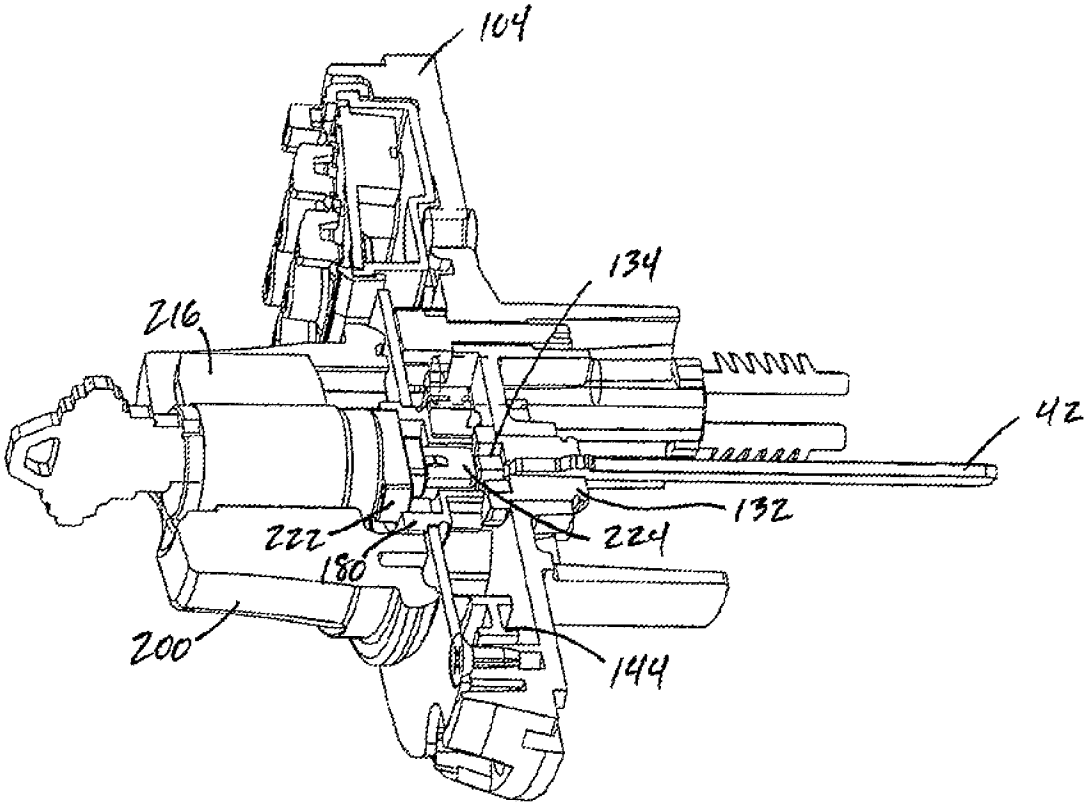
FIG. 7 is a view similar to FIG. 5 but with the key turned.
Figure 8:
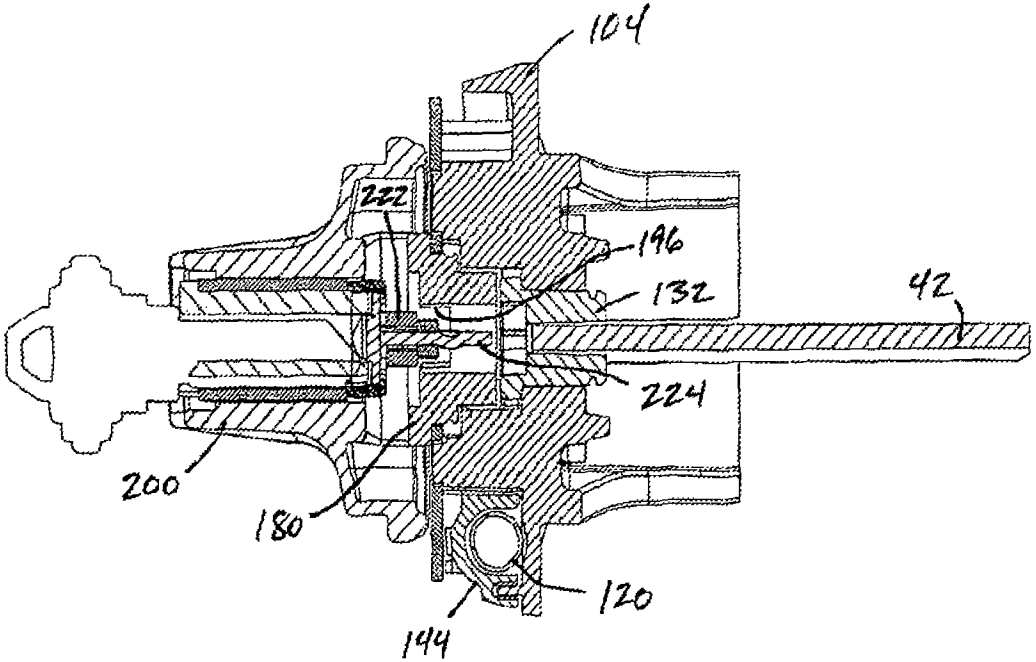
FIG. 8 is a horizontal sectional view of the deadbolt lock assembly in the same state as in FIG. 7.
Figure 9:
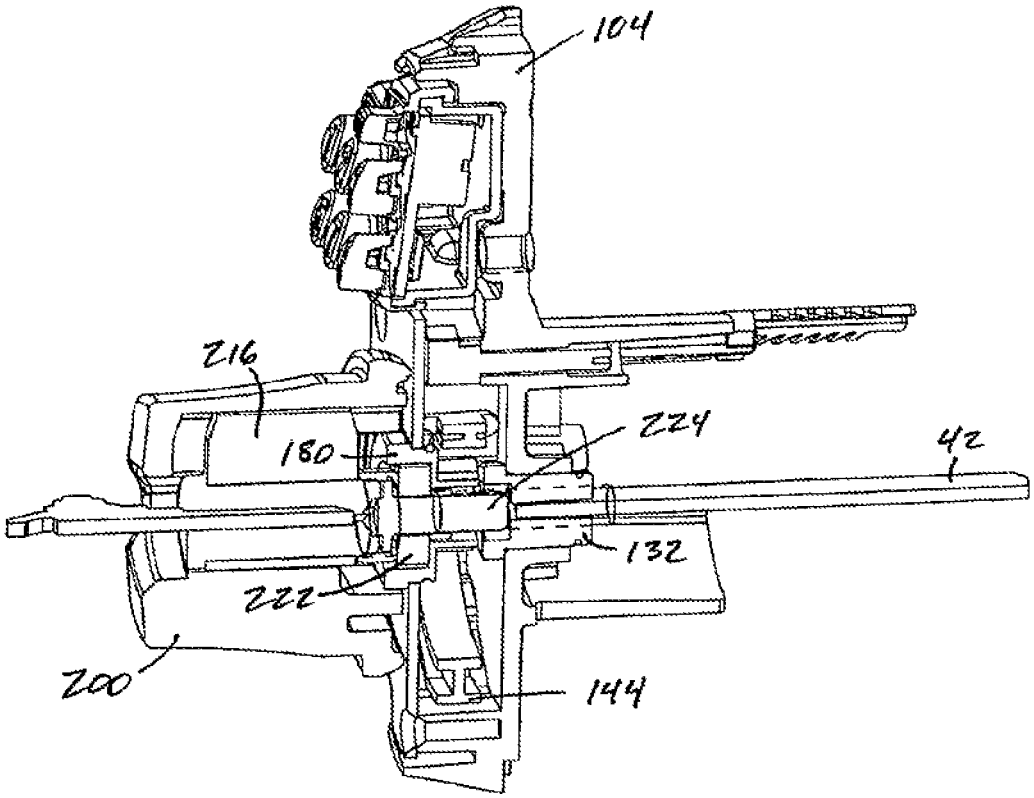
Figure 10:
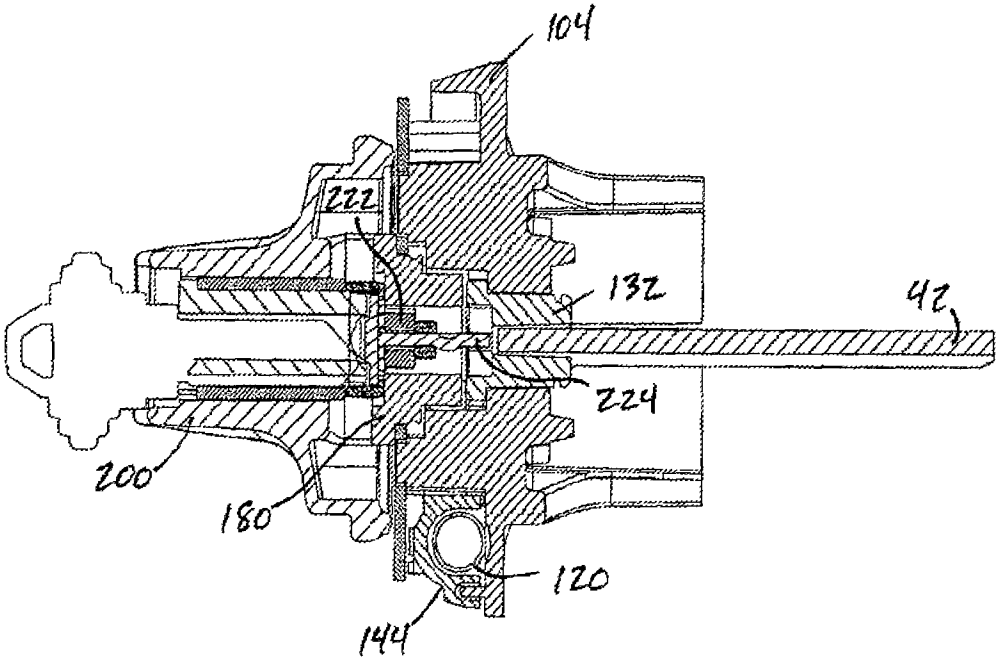
FIG. 10 is a horizontal sectional view of the deadbolt lock assembly in the same state as in FIG. 9.
Figure 11:
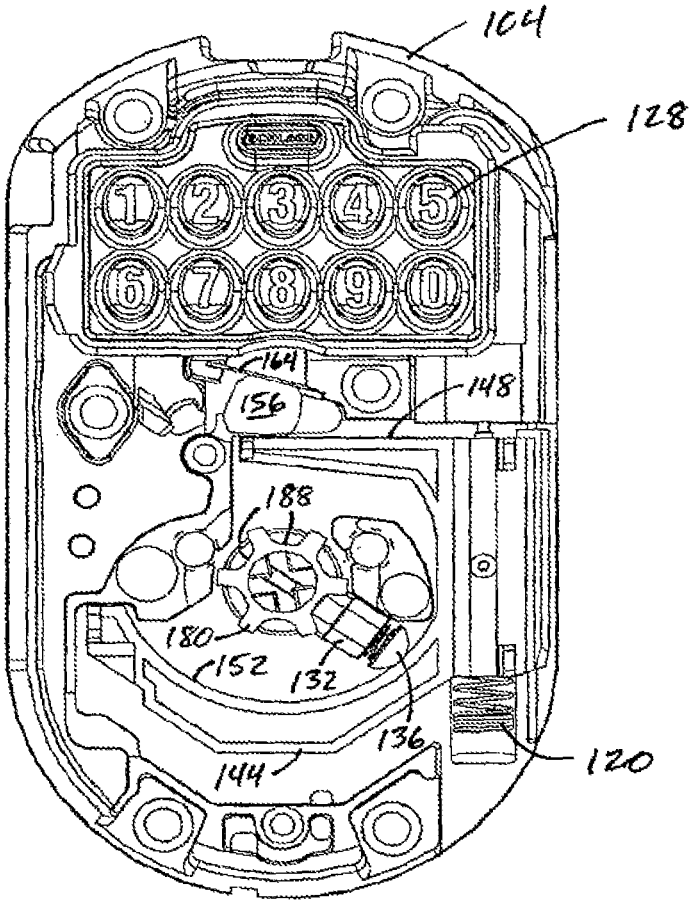
FIG. 11 is an elevational view of the outside escutcheon assembly with selected parts removed to show the wall in its raised position and the pin inserted in a notch of the adapter to engage the outside turnpiece.

The lock 208 includes an inner portion 220 that can be pivoted relative to the housing 212 with a key 221, as is known in the art. The inner portion 220 is movable between a locked position (FIG. 3) and an unlocked position. A generally rectangular blocking portion 222 extends axially from and pivots with the inner portion 220 of the lock. The blocking portion 222 extends horizontally when the inner portion 220 is in the locked position, and when so oriented the blocking portion 222 cannot be extended into the slot 196 in the adapter 180. Thus, in this orientation the blocking portion 222 blocks axial movement of the lock housing 212 relative to the turnpiece. A driver tab 224, which is rectangular in cross-section, extends axially from the blocking portion 222 and pivots with the portion 222 and with the inner portion 220 of the lock. When the key is not inserted in the lock and the turnpiece 200 is in the vertical position, the driver tab 224 extends horizontally when viewed from its end. When the key is inserted into the lock and turned ninety degrees (FIGS. 7 and 8), the blocking portion 222 and the driver tab 224 pivot ninety degrees such that the blocking portion 222 extends vertically and is aligned with the slot 196 in the adapter 180. The key can then be pushed in (FIGS. 9 and 10), moving the lock housing 212 inward relative to the turnpiece 200, and moving the driver tab 224 axially into the aligned slot 134 in the outer end of the clutching cam 132. The driver tab 224 can extend into either one of the slots 134 in clutching cam, depending on the pivotal position of the cam 132, which depends on whether the deadbolt is extended or retracted. Thereafter, pivotal movement of the turnpiece 200 causes pivotal movement of the adapter 180, the driver tab 224 and the clutching cam 132, which causes pivotal movement of the driver bar 42 as described above. The key can only be removed by pulling the lock housing out, which removes the driver tab 224 from the clutching cam 132 and thereby disconnects the turnpiece 200 and the driver bar 42. While the disclosed key operated lock mechanism is a cylinder lock, it should be understood that any type of key operated lock mechanism can be employed.

Figure 3:
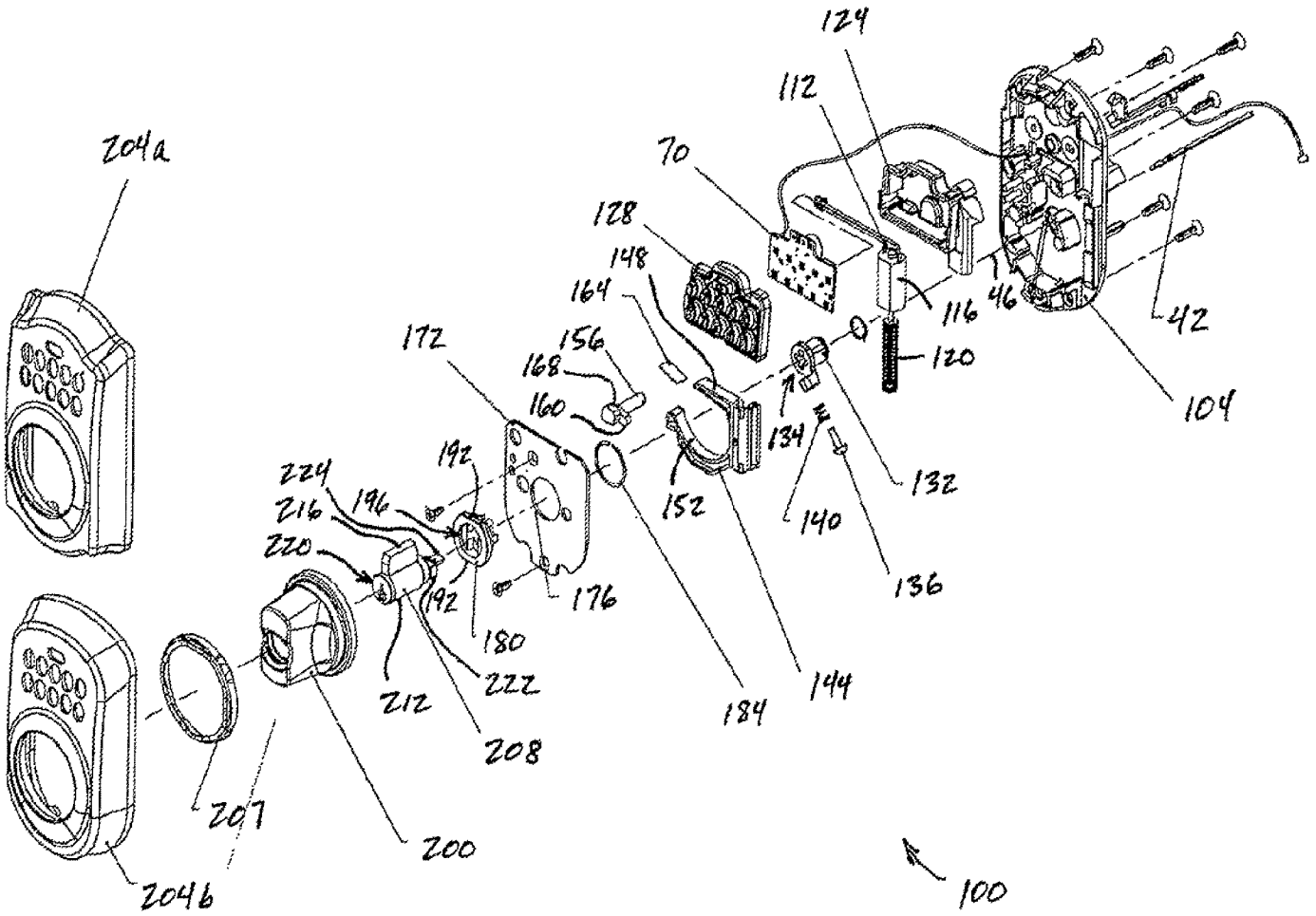
FIG. 3 is an exploded perspective view of the outside escutcheon assembly of the deadbolt lock assembly.
Figure 4:
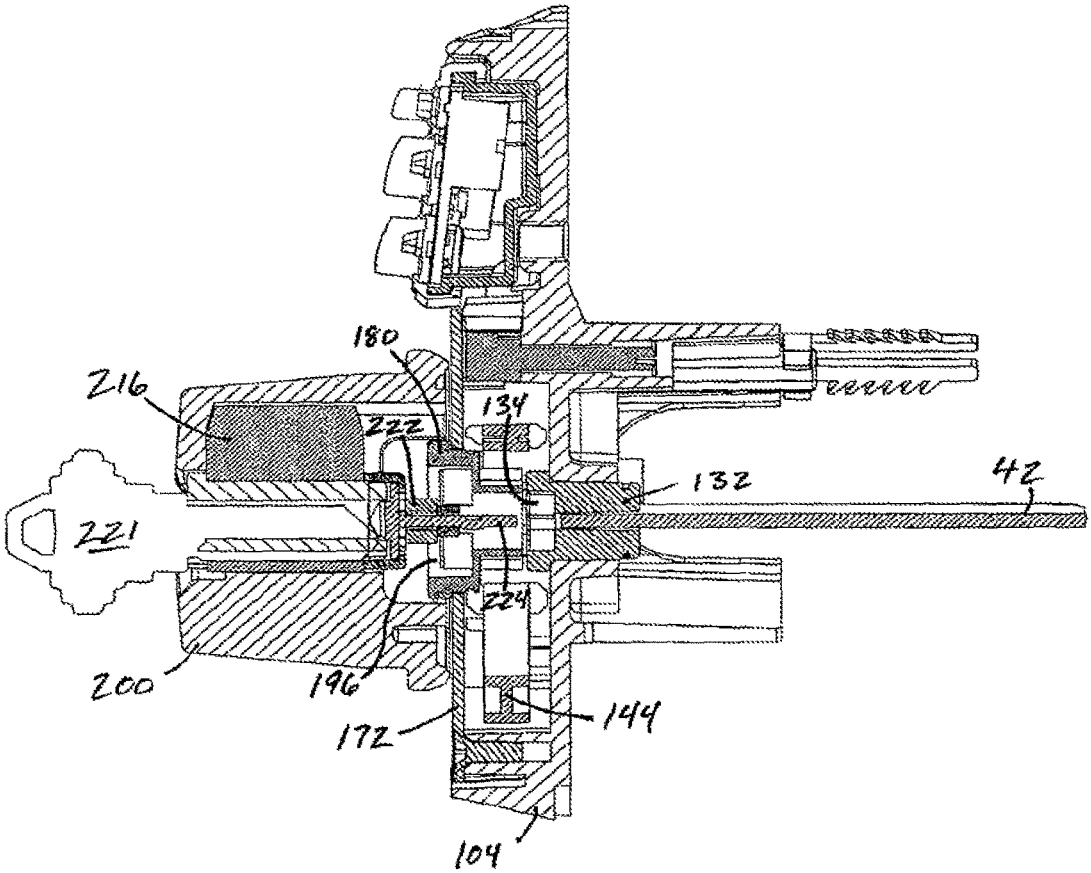
FIG. 4 is a vertical sectional view of the outside escutcheon assembly with the escutcheon removed and with the outside turnpiece disengaged and the key inserted in the cylinder lock but not turned.
Figure 5:
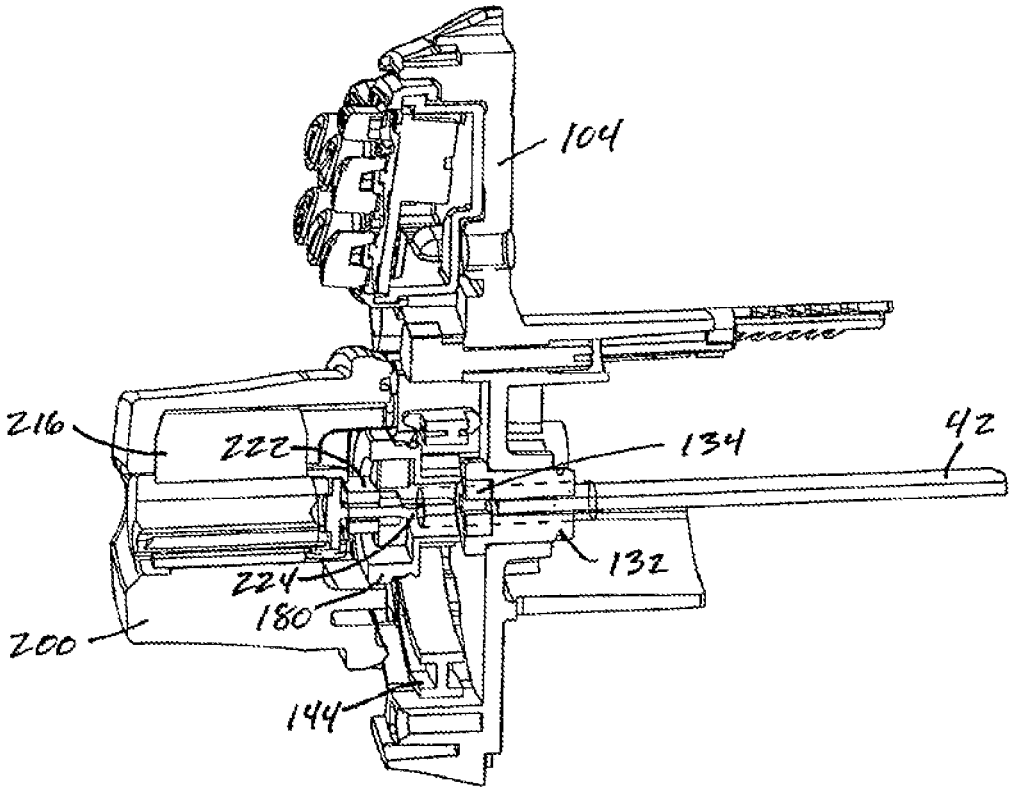
FIG. 5 is a perspective vertical sectional view similar to FIG. 4 but without the key inserted.
Figure 6:
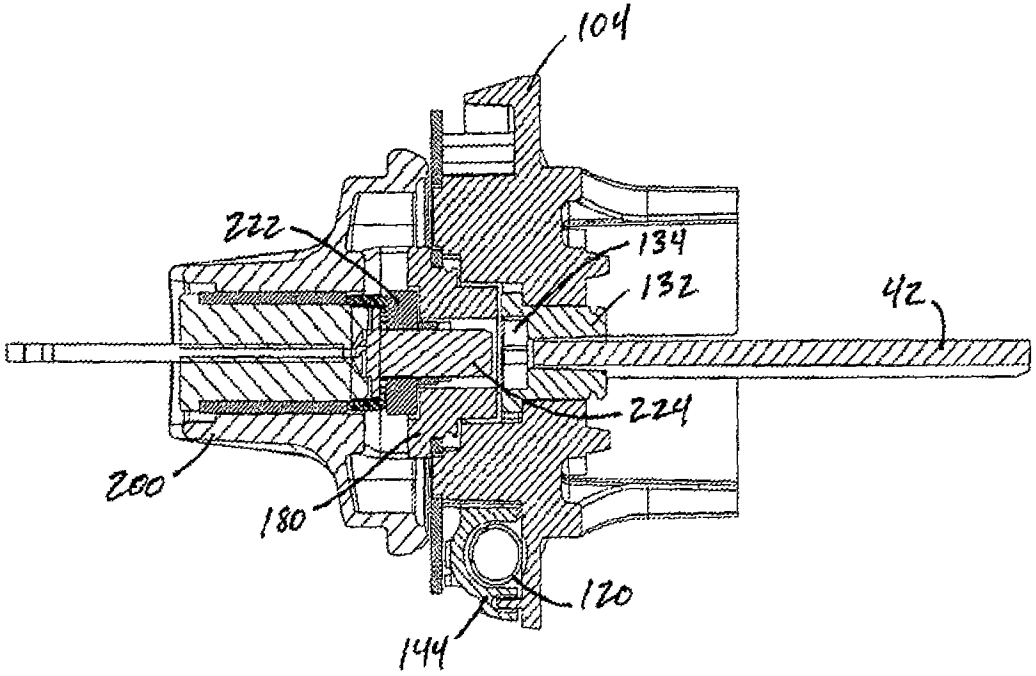
FIG. 6 is a horizontal sectional view of the deadbolt lock assembly in the same state as in FIG. 4.

An outer escutcheon 204, mentioned above, is mounted on the base plate 104 over the turnpiece. Alternative escutcheons 204*a* and 204*b* are shown in FIG. 3. A washer 207 is located between the turnpiece and the escutcheon.

When the deadbolt 22 is extended (locked), an operator on the outside of the door can retract the deadbolt (unlock the door) either with the keypad or with the key. An operator would choose to use the key if he or she has forgotten the code to be entered on the keypad, or if the keypad is not working, which could happen, for example, if the battery has lost power.

To use the key, the operator inserts the key in the lock 208, turns the key clockwise and pushes the key inward. As described above, this causes the driver tab 224 to enter the slot 134 in the caroming clutch 132 and thereby links the camming clutch 132 to the adapter 180. (The possibility of the driver tab 224 not immediately being aligned with the slot 134 is discussed below.) The operator can then turn the turnpiece 200, which pivots the driver bar 42 counterclockwise and retracts the deadbolt 22 in the conventional manner.

To use the keypad, the operator enters the programmed code on the keypad. The circuit board or controller 70 receives the input and sends a signal to the motor 116 causing the motor to move the wall 144 upwardly. This causes the wall to move the pin 136 into an aligned notch 188, which links the camming clutch 132 to the adapter 180.

(The possibility of the pin 136 not immediately being aligned with a notch 188 is discussed below.) The operator can then turn the turnpiece 200, which pivots the driver bar 42 counterclockwise and retracts the deadbolt 22. This movement of the driver bar also causes the cam 74 to close the switch 62, which sends a signal to the circuit board or controller 70. The controller 70 then initiates a "relock" time delay, which gives the operator a predetermined amount of time to relock the deadbolt from the outside. After the relock time delay, the controller 70 signals the motor 116 to lower the wall 144 and thereby disconnect the outside thumbturn 200 from the driver bar 42.

The operator can relock the door either from the outside, as mentioned above, or from the inside after entering through the door. From the inside, the operator can always turn the turnpiece 86 to lock the door. Relocking the door from either side pivots the cam 74 to open the switch 62, sending another signal to the controller 70. The controller 70 may either ignore the signal 62 from the switch or use it to truncate the relock time delay. In the former "ignore it" case, the controller 70 waits for the relock time to pass and then the controller signals the motor 116 to lower the wall 144 and disengage the camming clutch 132, after which the outside turnpiece 200 is no longer connected to the driver bar 42. In the latter or "truncate" case, when the controller 70 receives the signal that the switch 62 has opened, because the door has been locked, the controller immediately signals the motor 116 to lower the wall 144 and disengage the camming clutch 132, after which the outside turnpiece 200 is no longer connected to the driver bar 42. Thus, in the latter case, the relock time delay is truncated when the switch 62 opens due to relocking of the deadbolt.

If the operator entered with the key because the electronics were not working, there would be no need to disengage the outside turnpiece 200 if the turnpiece was not connected to the driver bar 42 in the first place. If, however, the electronics failed after connecting the outside turnpiece 200 to the driver bar 42, the controller 70 could not disengage the outside turnpiece 200 after entry. The manual release cam 156 allows the operator to manually disengage the outside turnpiece 200 in the unlikely event of such electronic failure. As described above, the operator can remove the inside escutcheon 82 and use a screwdriver to pivot the cam 156 and lower the wall 144, thereby disengaging the outside turnpiece 200.

To unlock the deadbolt from the inside, the operator merely has to turn the turnpiece 86 clockwise. Because the turnpiece 86 is always engaged with the driver bar 42, this retracts the deadbolt 22. This also closes the switch 62, as described above, which signals the controller 70 to raise the wall 144, thereby engaging the outside turnpiece 200, and initiating the relock time delay. After exiting through the door, the operator has until the expiration of the relock time delay to relock the door. After expiration of the relock time delay, the outside turnpiece 200 is disengaged. If the door has already been relocked, it can no longer be opened from the outside without entering the code or using the key. If the door has not been relocked, it can no longer be locked from the outside without entering the code or using the key. If the controller is set to truncate the relock time delay, the outside turnpiece 200 is disengaged immediately after the door is relocked.

In another mode of operation, the outside thumbturn 200 remains connected with the driver bar 42 indefinitely (i.e., clutch mechanism stays in the engaged configuration) until the operator extends the bolt 22 to secure the door. In other words, the relock time delay is indefinite. When the door is relocked, the controller 70 disengages the outside turnpiece 200.

In another mode of operation, when the operator retracts the bolt 22 from the inside, the controller 70 receives the signal from the switch 62 but the controller does not operate the motor 116 to engage the outside turnpiece 200 until the controller 70 receives a second signal that is generated by pushing a specific key or similar means on the outside keypad 128. Until the designated key is pushed, the outside thumbturn 200 remains disconnected from the driver bar 42 and the bolt 22 remains in the retracted position, with the door thus being in an unsecured/unlocked state. Once the operator pushes the designated key, the controller 70 operates the motor to connect the outside thumbturn 200 with the driver bar 42. The operator may then throw/extend the bolt 22 to secure the door to the doorframe, and such movement opens the switch 62, which causes the controller 70 to operate the motor to disconnect the outside thumbturn 200 from the driver bar 42, thus locking the door.

It should be apparent that the states of the switch 62 could be reversed, such that the switch is closed when the deadbolt is locked and open when the deadbolt is unlocked.

The outside thumbturn 200 could conceivably be in any rotational orientation when an operator tries to turn it either to lock or unlock the door. The six notches 188 in the adapter 180 allow for this in the event the operator is using the keypad. When the operator uses the keypad to engage the turnpiece 200, the motor 116 tries to raise the wall 144 to move the pin 136 into a notch 188 aligned with the pin 136. If a notch 188 is so aligned, the pin 136 moves into the notch 188 and couples the adapter 180 to the clutching cam 132, which enables use of the thumbturn 200 as described above. If a notch 188 is not so aligned, the pin 136 will engage a portion of the adapter 180 between two notches, and this will prevent further inward movement of the pin 136 and further upward movement of the wall 144. As the motor continues to rotate the spring 120 in an attempt to raise the wall 144, the spring will extend or stretch when upward movement of the wall 144 stops. Thereafter, when the operator starts to turn the turnpiece 200, the pin will quickly become aligned with an adjacent notch 188, and the spring 120 will then return to its normal length and will pull the wall 144 upward causing the pin 136 to move into the now-aligned notch 188. The turnpiece 200 is then engaged.

In the event the operator is using the key, it is possible the driver tab 224 will not be aligned with the slot 134 in the clutching cam 132 when the operator tries to push the key in. Then the driver tab 224 will bump into the end of the cam 132, and the operator will not be able to push the key in. Further turning of the key a slight amount, which will also turn the turnpiece 200, will bring the driver tab 224 into alignment with the slot 134, after which the operator will be able to push the key in and couple the turnpiece 200 to the driver bar 42.

Whether the keypad or the key is used to lock or unlock the door, the force necessary to pivot the driver bar 42 and move the deadbolt 22 is provided by the operator, not by a motor or other device, such as a solenoid. In other words, a force applied to the turnpiece 200 by the operator is mechanically transmitted to the deadbolt, so that the operator manually moves the deadbolt. In the construction described above, the force is transmitted to the deadbolt by, among other things, the driver bar 42. Having the force needed to throw the deadbolt provided by the operator provides advantages over electronic deadbolts that use a motor or solenoid to move the deadbolt when a proper credential is presented. With such devices, if the deadbolt is not properly aligned with the receiving opening in the door frame when the operator attempts to lock the door, the motor or solenoid may continue to attempt to throw the bolt until the battery dies, or the motor or solenoid may stop trying to throw the bolt without the operator knowing that the deadbolt is not secured. With the lock assembly 10, if the deadbolt 22 is not properly aligned with the receiving opening in the door frame when the operator attempts to lock the door, the operator will not be able to fully turn the turnpiece 200, and the operator will thereby become aware of the problem.

Figure 12:
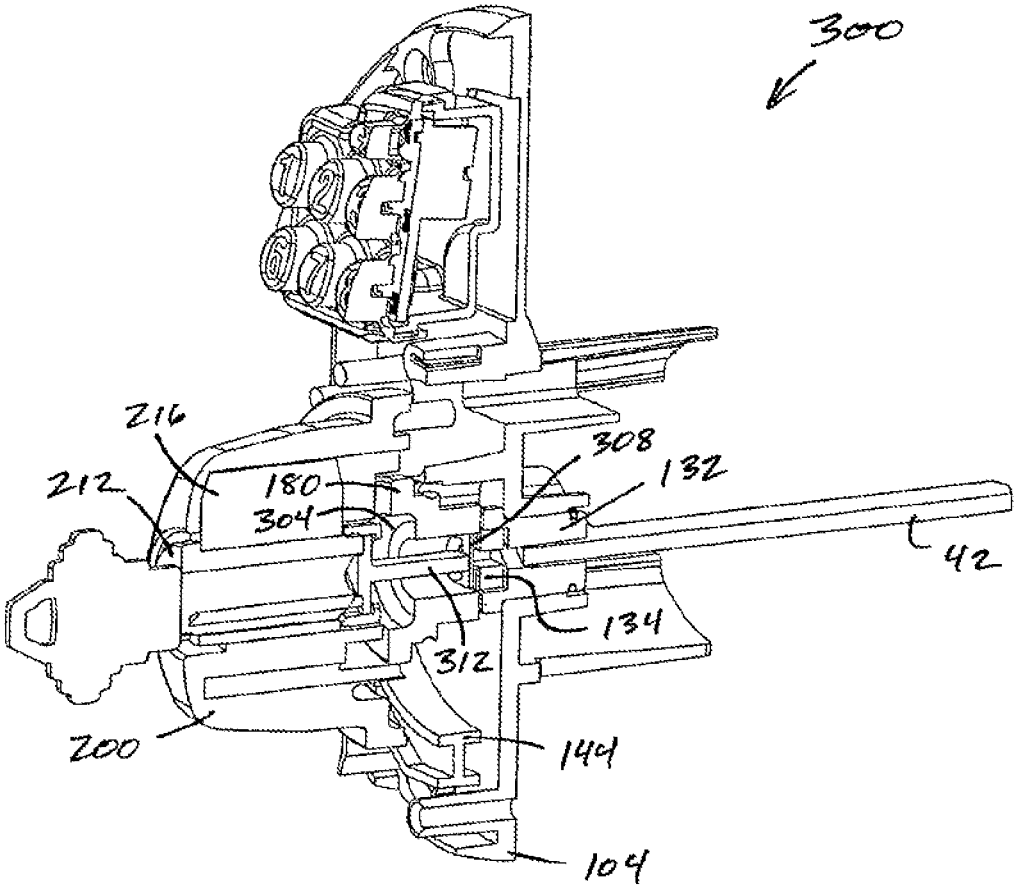
FIG. 12 is a perspective sectional view of an alternative outside escutcheon assembly with the escutcheon removed and with the outside turnpiece disengaged and the key inserted in the cylinder lock but not turned.
Figure 13:
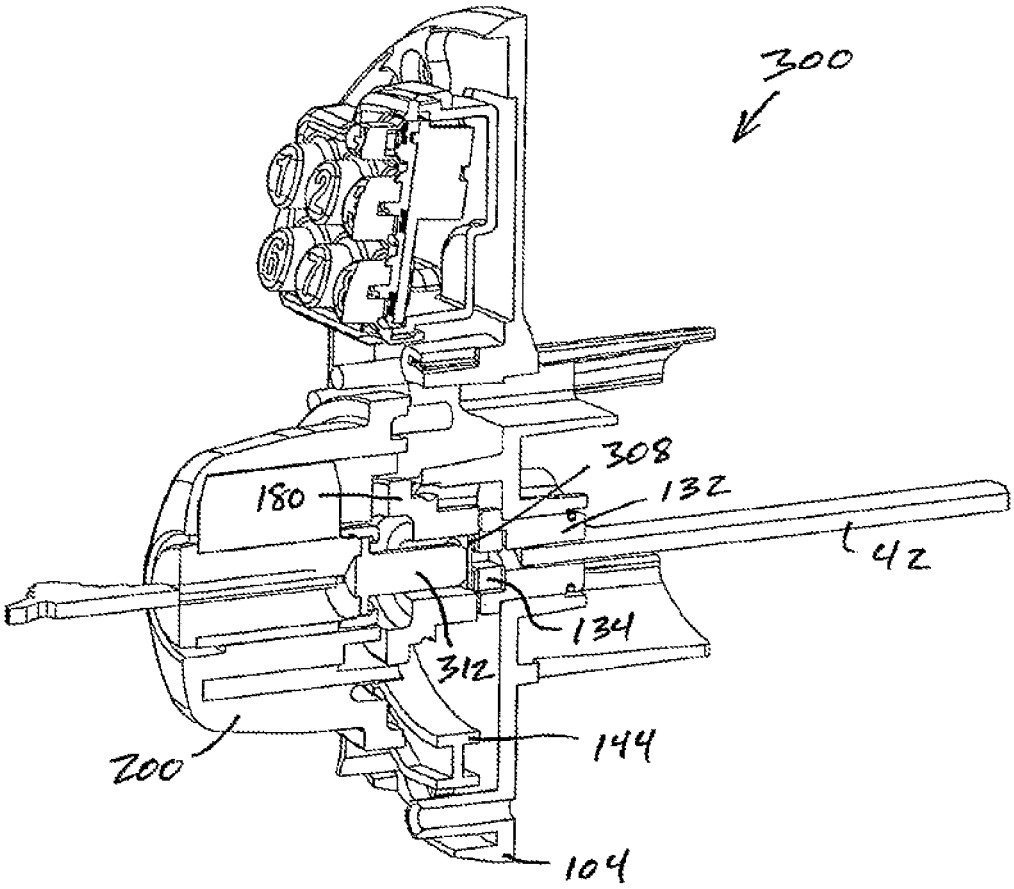
FIG. 13 is a view similar to FIG. 12 but with the key turned.
Figure 14:
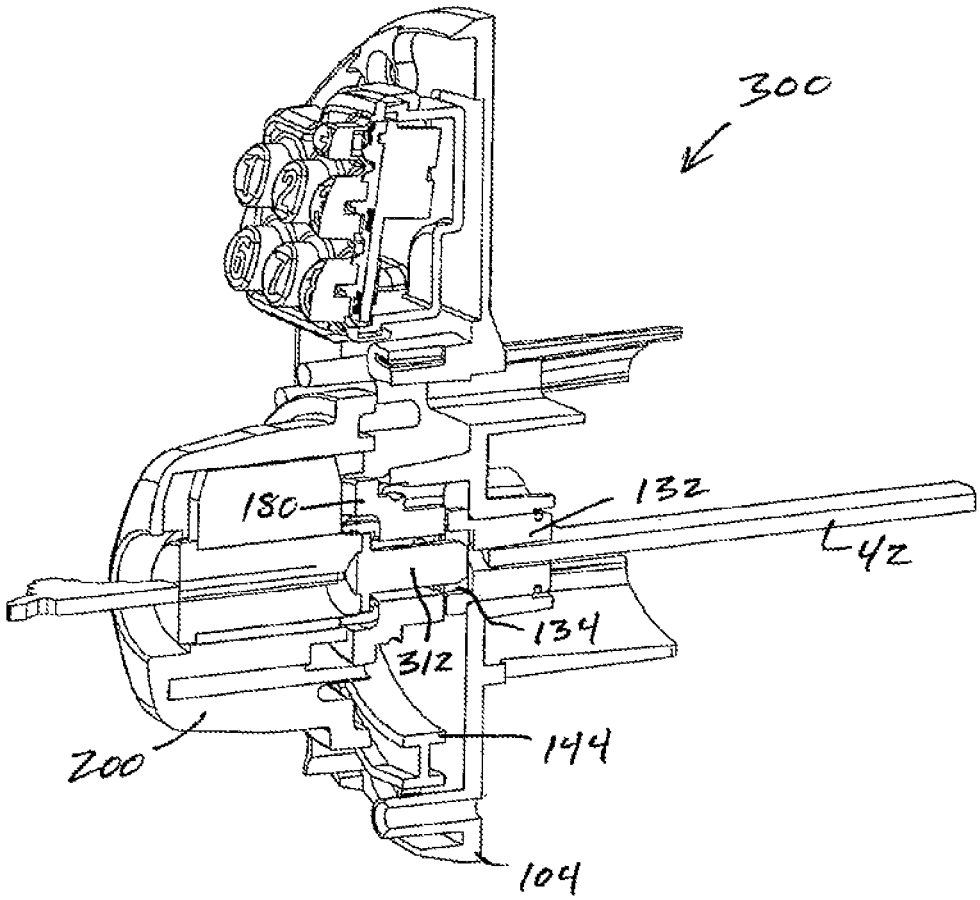

An alternative lock assembly 300 is illustrated in FIGS. 12-14. Except as described below, the lock assembly 300 is substantially identical to the lock assembly 10, and common elements have been given the same reference numerals.

Instead of a slot in its outer end, the adapter 180 of the lock assembly 300 has in its outer end a cylindrical recess 304 into which the inner end of the lock housing 212 can extend. The inner end of the adapter 180 has therein a slot 308 that extends vertically when the turnpiece 200 extends vertically, as shown in FIG. 12. The inner end of the lock housing 212 has extending axially therefrom a driver bar or tailpiece 312 connected to the cylinder lock inner portion 220 for rotation therewith. The tailpiece 312 is rectangular in cross-section, with its longer dimension extending perpendicular to the key. Thus, when the turnpiece 200 and key are vertical as shown in FIG. 12, the tailpiece 312 extends horizontally. Because the slot 308 in the adapter 180 extends vertically when the turnpiece 200 is vertical, the tailpiece 312 cannot be inserted into the slot 308 when the key is also vertical. Engagement of the tailpiece 312 with the inner end of the adaptor 180 thus prevents axially inward movement of the key.

When the key is turned ninety degrees relative to the turnpiece 200, as shown in FIG. 13, the tailpiece 312 becomes aligned with the slot 308. The key can then be pushed inward, as shown in FIG. 14, to move the inner end of the tailpiece 312 into the slot 308 and into an aligned slot 134 in the clutching cam 132. Thereafter, pivotal movement of the turnpiece 200 causes pivotal movement of the adapter 180, the tailpiece 312 and the clutching cam 132, which causes pivotal movement of the driver bar 42.

The tailpiece 312 can be made collapsible to resist opening of the lock assembly 300 by a physical attack on the cylinder lock 208. If the cylinder lock 208 were hammered or otherwise forced inward without inserting and turning the key, engagement of the tailpiece 312 and the inner end of the adapter 180 (with the tailpiece 312 not being aligned with the slot 308) would cause the tailpiece 312 to collapse, thereby preventing engagement of the turnpiece 200 with the driver bar 42.

The invention claimed is:

1. A deadbolt lock assembly comprising a retractable and extendable deadbolt, a housing, an outside member movably mounted on the housing, the member being normally disconnected from the deadbolt, and an operator input device on the housing, the device connecting the member to the deadbolt in response to presentation of an appropriate credential, such that a force applied to the member by the operator is mechanically transmitted to the deadbolt to move the deadbolt;

wherein with the member disconnected from the deadbolt, the member has a plurality of rotational positions in which the device is operable to connect the member to the deadbolt.

2. A deadbolt lock assembly as set forth in claim 1 wherein the input device includes a code entry device.

3. A deadbolt lock assembly as set forth in claim 2 wherein the code entry device is a keypad, and wherein the input device also includes a mechanism for connecting the member to the deadbolt in response to entry of a predetermined code on the keypad.

4. A deadbolt lock assembly as set forth in claim 1 wherein the member is a turnpiece pivotally mounted on the housing.

5. A deadbolt lock assembly as set forth in claim 4 and further comprising a driver bar pivotally mounted on the housing and operably connected to the deadbolt, and wherein the input device connects the turnpiece to the driver bar such that the driver bar pivots with the turnpiece.

6. A lock system, comprising:

an escutcheon configured for mounting on a door;

a credential reading device mounted on the escutcheon;

a controller in communication with the credential reading device, the controller configured to send a signal in response to a proper credential provided to the credential reading device;

a motor mounted in the escutcheon and in communication with the controller, the motor including an output shaft drivingly connected to a coil spring, wherein the motor is configured to rotate the coil spring in response to the signal;

a wall including an arcuate cam surface, the wall having a first position and a second position, wherein the wall is operably connected with the coil spring and is configured to move from the first position toward the second position in response to rotation of the coil spring;

a turnpiece rotatably mounted on the escutcheon;

an adapter rotationally coupled with the turnpiece, the adapter including a plurality of notches;

a driver bar extending along a longitudinal axis;

a deadbolt assembly including a deadbolt, wherein the deadbolt assembly is engaged with the driver bar and is configured to drive the deadbolt in response to rotation of the driver bar about the longitudinal axis;

a clutching cam rotationally coupled with the driver bar; and a pin movably supported by the clutching cam and engaged with the arcuate cam surface, the pin having a disengaged position in which the pin does not rotationally couple the clutching cam and the adapter, and the pin having an engaged position in which the pin extends into one of the notches and rotationally couples the clutching cam and the adapter; and wherein the pin is engaged with the arcuate cam surface and is configured to move from the disengaged position toward the engaged position in response to movement of the wall from the first position toward the second position.

7. The lock system of claim 6, wherein the credential reading device comprises a keypad.

8. The lock system of claim 6, wherein the pin is biased toward the disengaged position.

9. The lock system of claim 6, wherein, with the wall in the second position, the arcuate cam surface is centered on the longitudinal axis.

10. The lock system of claim 6, wherein a portion of the wall that into a coil of the coil spring such that rotation of the spring linearly drives the wall between the first and second positions.

11. The lock system of claim 10, wherein the first position is a lower position and the second position is an upper position.

12. The lock system of claim 6, further comprising:

a switch in communication with the controller; and a cam rotationally coupled with the driver bar, wherein the cam is configured to engage the switch when the deadbolt is in an extended position;

wherein the switch is configured to send a second signal to the controller when engaged by the cam;

wherein the controller is configured to issue a third signal in response to the second signal; and wherein the motor is configured to rotate the spring in an opposite direction in response to the third signal, thereby moving the wall from the second position to the first position and moving the pin from the engaged position to the disengaged position.

13. A deadbolt lock assembly, comprising:

a housing;

a retractable and extendable deadbolt;

a driver bar pivotally mounted on the housing and operably connected to the deadbolt;

a clutching cam connected to the driver bar for movement therewith;

a turnpiece mounted on the housing, the turnpiece being normally disconnected from the driver bar;

an adapter connected to the turnpiece for movement therewith, the adapter including a plurality of notches;

a pin mounted on the clutching cam for movement relative thereto with respect to the adapter, the pin having a coupling position in which the pin extends into one of the notches and a decoupling position in which the pin does not extend into any of the notches, and the pin being mounted on the clutching cam for pivotal movement therewith such that when the pin is in the coupling position, pivotal movement of the adapter causes pivotal movement of the clutching cam, and such that when the pin is in the decoupling position, pivotal movement of the adapter does not cause pivotal movement of the clutching cam;

a credential reading device on the housing;

a controller configured to receive input from the credential reading device and to send a signal when an appropriate credential is presented to the credential reading device;

a motor configured to rotate an output shaft in response to the signal;

a coil spring rotationally coupled with the output shaft;

a wall movable relative to the housing, wherein the wall is engaged with the pin and with the coil spring, and is configured to move the pin into the notch in when the coil spring is rotated, thereby connecting the adapter to the driver bar.

14. The deadbolt lock assembly of claim 13, wherein the pin includes a first end facing proximate the adapter and a second end engaged with the wall;

wherein the plurality of the notches are angularly spaced about the adapter;

wherein each of the notches is sized and configured to receive the first end of the pin; and wherein when the first end of the pin is received in any of the notches, the adapter is rotationally coupled with the clutching cam.

15. The deadbolt lock assembly of claim 14, wherein the wall has a first wall position and a second wall position, and the spring is configured to linearly urge the wall between the first and second wall positions in response to rotation of the output shaft;

wherein the pin has the decoupling position in response to the first wall position, and has the decoupling position in response to the second wall position;

wherein, with the pin in the decoupling position, the first end of the pin is not received in any of the notches;

wherein, with the pin in the coupling position, the first end of the pin is received in one of the notches;

wherein the wall includes an arcuate surface engaged with the second end of the pin; and wherein, with the wall in the second wall position, the arcuate surface is centered on a pivot axis of the adapter.

16. The deadbolt lock assembly of claim 15, wherein when the first end of the pin is misaligned with the notches, the pin blocks the wall from moving from the first wall position to the second wall position;

wherein the spring is configured to expand in response to rotation of the output shaft when the wall is blocked from moving to the second wall position, and to subsequently move the wall to the second wall position when the first end of the pin becomes aligned with one of the notches.

* * * * *